US010605432B2

(12) United States Patent
Onaka et al.

(10) Patent No.: US 10,605,432 B2
(45) Date of Patent: Mar. 31, 2020

(54) ILLUMINATION DEVICE

(71) Applicant: CMC MAGNETICS CORPORATION, Taipei (TW)

(72) Inventors: Shuji Onaka, Tokyo (JP); Yutaka Saito, Tokyo (JP)

(73) Assignee: CMC MAGNETICS CORPORATION, Taipei (TW)

( * ) Notice: Subject to any disclaimer, the term of this patent is extended or adjusted under 35 U.S.C. 154(b) by 0 days.

(21) Appl. No.: 16/383,749

(22) Filed: Apr. 15, 2019

(65) Prior Publication Data

US 2019/0234586 A1 Aug. 1, 2019

Related U.S. Application Data

(63) Continuation of application No. PCT/JP2017/037599, filed on Oct. 17, 2017.

(30) Foreign Application Priority Data

Oct. 18, 2016 (JP) ..... 2016-204186

(51) Int. Cl.
*F21V 7/06* (2006.01)
*F21S 8/02* (2006.01)
(Continued)

(52) U.S. Cl.
CPC ..... *F21V 7/06* (2013.01); *F21S 8/026* (2013.01); *F21V 7/04* (2013.01); *F21V 7/09* (2013.01); *F21Y 2115/10* (2016.08)

(58) Field of Classification Search
CPC ... F21V 7/04; F21V 7/045; F21V 7/06; F21V 7/07; F21V 7/08; F21V 7/09; F21Y 2115/10
See application file for complete search history.

(56) References Cited

U.S. PATENT DOCUMENTS 6,454,433 B1 * 9/2002 Alessio ..... F21L 4/005 362/157
2007/0189019 A1 * 8/2007 Klipstein ..... F21S 6/003 362/347

(Continued)

FOREIGN PATENT DOCUMENTS

| | | |
|---|---|---|
| EP | 2 843 292 A1 | 3/2015 |
| JP | 2014-239008 | 12/2014 |
| JP | 2015-46300 | 3/2015 |

OTHER PUBLICATIONS

International Search Report dated Jan. 9, 2018 in PCT/JP2017/037599 filed on Oct. 17, 2017 (with English Translation).

(Continued)

*Primary Examiner* — Alexander K Garlen
(74) *Attorney, Agent, or Firm* — Pillsbury Winthrop Shaw Pittman LLP

(57) ABSTRACT

The present invention aims at providing an illumination device which can improve a light distribution shape while suppressing the occurrence of glare. The illumination device according to the present invention includes an LED module and a reflector. A reflecting side surface of the reflector is obtained by rotating a curve with respect to an optical axis, the curve obtained by connecting an arc defined by a circle and an arc defined by another circle substantially inscribed to the circle.

7 Claims, 7 Drawing Sheets

(51) Int. Cl.

| | |
|---|---|
| ***F21V 7/09*** | (2006.01) |
| ***F21V 7/04*** | (2006.01) |
| ***F21Y 115/10*** | (2016.01) |

(56) References Cited

U.S. PATENT DOCUMENTS

| | | | | |
|---|---|---|---|---|
| 2014/0063792 | A1 | 3/2014 | Spencer et al. | |
| 2014/0268750 | A1* | 9/2014 | Lui | F21S 8/061 362/235 |
| 2015/0241024 | A1* | 8/2015 | Smith | F21K 9/233 362/296.07 |
| 2015/0241037 | A1 | 8/2015 | Zhang et al. | |
| 2017/0038049 | A1* | 2/2017 | Zheng | F21V 29/10 |

OTHER PUBLICATIONS

Written Opinion dated Jan. 9, 2018 in PCT/JP2017/037599 filed on Oct. 17, 2017.

* cited by examiner

FIRST EXAMPLE

SECOND EXAMPLE

THIRD EXAMPLE

FIRST COMPARATIVE EXAMPLE

SECOND COMPARATIVE EXAMPLE

FOURTH COMPARATIVE EXAMPLE

ILLUMINATION DEVICE

CROSS REFERENCE TO RELATED APPLICATION(S)

This application is a continuation of international application No. PCT/JP2017/037599 filed on Oct. 17, 2017 based upon and claiming the benefit of priority of Japanese patent application No. 2016-204186 filed on Oct. 18, 2016, the contents of which are incorporated herein by reference in its entirety. In addition, all references cited herein are incorporated in their entirety.

BACKGROUND OF THE INVENTION

1. Field of the Invention

The present invention relates to an illumination device including a light emitting module which includes a light emitting element of a Light Emitting Diode (LED) as a light source.

2. Description of the Related Art

In the related art, an LED module of a point light source type or a surface light source type including a light emitting element such as an LED is widely used in an illumination device. The LED module of the point light source type or the surface light source type emits light in a direction spreading from an optical axis as a whole, and generally irradiates a wide range with light. Therefore, a reflector for narrowing the irradiation range and condensing the light is attached to the illumination device using the LED module, and is used in an illumination device such as a downlight installed on a ceiling.

The LED module is a light source which is excellent in terms of power saving, small size, and long life, or the like and particularly, in recent years, light emission intensity which can be output is improved with the progress of technology development, and the LED module can also be used in an environment requiring higher brightness. On the other hand, when the LED module having high emission intensity is used as a light source of the downlight, if light emitted by the LED is directly incident on a field of view of a person without being reflected by the reflector, unpleasant dazzle, that is, glare may occur. Particularly, when direct light is emitted in a direction away from the optical axis of the LED module, since the direct light is incident at a shallow elevation angle with respect to the field of view of the person, the glare is more likely to occur.

As a measure against the glare as described above, for example, an LED illumination device disclosed in US 2014/0063792 A1 as Patent Literature 1 has been proposed. In the LED illumination device of US 2014/0063792 A1, the shape of a reflector is different from a conventional bowl shape which projects outwardly, and is formed in a hyperbolic shape which projects inwardly. By employing the hyperbolic reflector, the LED illumination device of US 2014/0063792 A1 aims to realize smooth light distribution while suppressing the occurrence of glare as compared with the conventional bowl-shaped reflector.

On the other hand, JP-A-2015-46300 as Patent Literature 2 discloses a reflector formed in a "warped shape", that is, a cross-sectional shape of a reflecting surface projects inwardly as a reflector which can illuminate a wide range brightly and aims at blurring an outline of irradiation light to obtain light distribution with less discomfort. Specific examples of the shapes of the reflecting surface include those based on a part of a parabola, a part of an ellipse, and a part of a circle.

Patent Literature 1: US 2014/0063792 A1

Patent Literature 2: JP-A-2015-46300

SUMMARY OF THE INVENTION

However, in the hyperbolic reflector disclosed in US 2014/0063792 A1, a ½ beam angle is optimal in condition that a light source is an ideal point light source. According to the studies by the present inventors, the hyperbolic reflector has a problem in that as an area of a light emitting surface of the light source increases, the emitting light condenses on the optical axis, the light distribution shape deteriorates, and uneven brightness occurs on an irradiation surface. That is, when an emission angle of direct light is limited by the hyperbolic reflector in order to suppress the occurrence of glare, in particular, when the light source is a surface light source, the light distribution shape may deviate from an ideal shape.

On the other hand, according to the studies of the present inventors, even when the ½ beam angle is large, a reflector disclosed in JP-A-2015-46300 having a cross-sectional shape based on a part of a parabola, a part of an ellipse, or a part of a circle is not suitable for suppressing the occurrence of glare, and it becomes clear that a problem of uneven brightness with respect to the irradiation surface also occurs.

The present invention is made in view of such a problem, and an object thereof is to provide an illumination device capable of improving a light distribution shape while suppressing the occurrence of glare even when an LED is a surface light source.

According to a first aspect of the present invention, an illumination device includes a semiconductor light emitting device which includes a light emitting surface and a supported surface located on a side opposite to the light emitting surface; and a reflecting part which includes an incident circular opening with a radius R1 on which light from the semiconductor light emitting device is incident, an emission circular opening which emits light incident from the semiconductor light emitting device and includes an opening with a radius R2 larger than the radius R1, and a reflecting side surface which guides light from the incident circular opening toward the emission circular opening, in which the reflecting side surface of the reflecting part is a surface obtained by rotating a curve with respect to an optical axis of the semiconductor light emitting device, the curve being obtained by connecting a first arc which is defined by a first circle and extends from the light emitting surface of the semiconductor light emitting device in a light emitting direction and a second arc which is defined by a second circle substantially inscribed to the first circle, a center of the first circle is located in a position shifted toward the supported surface from the light emitting surface, and when a contact point between light emitted from one end of the light emitting surface and the second arc which is connected to the first arc extending in a light emitting direction from another end portion which faces one end portion of the light emitting surface is defined as a contact point T, a distance r from the contact point T to a foot of a perpendicular line perpendicular to the optical axis of the semiconductor light emitting device, a distance d from the foot of the perpendicular line to the light emitting surface, and the radius R1 satisfy $d/(R1+r) \geq 0.6$.

In the first aspect of the present invention, of the light emitted by the semiconductor light emitting device, an angle of direct light emitted from the emission circular opening without being reflected by the reflecting part is limited to an angle satisfying $d/(R1+r) \geq 0.6$. Therefore, it is possible to suppress the occurrence of glare caused by the direct light incident on a field of view of a person at a shallow elevation angle. Moreover, since the reflection side surface of the reflecting part according to the present invention includes a first circular arc and a second circular arc, it is possible to reduce the concentration of light around the optical axis by the curvature of the reflecting side surface formed of the first arc, while forming an outline of the light distribution shape of an illumination area by the curvature of the reflecting side surface formed of the second arc. Thus, the illumination device according to the first aspect of the present invention can improve the light distribution shape while suppressing the occurrence of glare even when the semiconductor light emitting device is a surface light source.

In a second aspect of the present invention according to the first aspect, an angle between a tangent line at the incident circular opening of the first circle and the light emitting surface of the semiconductor light emitting device is 80 degrees or more.

In the second aspect of the present invention, when the light emitted by the semiconductor light emitting device is reflected by the first arc, since a direction of the reflected light is not guided in the direction along the optical axis, a risk of concentrating the illumination light emitted from the emission circular opening in the vicinity of the optical axis can be reduced.

In a third aspect according to the first or the second aspect, a tangent line of the first circle and a tangent line of the second circle intersect each other at an angle of 5 degrees or less at a connecting point of the first arc and the second arc.

In the third aspect of the present invention, since the first arc and the second arc are smoothly connected, a risk of occurrence of unevenness of the light reflected by the reflecting part in the vicinity of the connection point can be reduced.

In a fourth aspect according to any one of the first to third aspects, the second arc has a length of twice or more and 10 times or less of the first arc.

In the fourth aspect of the present invention, since the length of the second arc is twice or more than that of the first arc, it is possible to prevent a dark place (dark spot) from being formed around the optical axis with respect to an irradiation surface of the illumination device 1. Since the length of the second arc is 10 times or less than that of the first arc, it is possible to prevent a bright place (light spot) from being formed around the optical axis with respect to an irradiation surface of the illumination device 1.

In a fifth aspect according to any one of the first to fourth aspects, the distance d is half or more of a distance L between a foot of a perpendicular line perpendicular to the optical axis from an end point of the emission circular opening and the light emitting surface.

In the fifth aspect of the present invention, since the light emitted by the semiconductor light emitting device can be reflected on a wider surface of the reflecting part, the light distribution shape can be further widened.

In a sixth aspect according to any one of the first to fifth aspects, the reflecting side surface of the reflecting part is a surface obtained by rotating a curve with respect to the optical axis, the curve being obtained by further connecting a third arc which is defined by a third circle substantially inscribed to the second circle and the second arc.

In the sixth aspect of the present invention, since the reflection side surface of the reflection part can set the radius R2 of the emission circular opening by the third arc, a size of the illumination device can be adjusted without changing the shapes of the first arc and the second arc.

In a seventh aspect according to any one of the first to sixth aspects, the semiconductor light emitting device is a chip-on board-type device including an LED.

In the seventh aspect of the present invention, it is not necessary to separately dispose a member such as a lens on the semiconductor light emitting device, and a decrease in light emitting efficiency can be suppressed as compared with a surface mounting type illumination device.

According to the illumination device of the present invention, even when the LED is a surface light source, it is possible to provide the illumination device which can improve light distribution while suppressing the occurrence of glare.

BRIEF DESCRIPTION OF THE DRAWINGS

FIG. 6A is a graph showing a light distribution shape of a first example; FIG. 6B is a graph showing a light distribution shape of a second example; FIG. 6C is a graph showing a light distribution shape of a third example; FIG. 6D is a graph showing a light distribution shape of a first comparative example; FIG. 6E is a graph showing a light distribution shape of a second comparative example; and FIG. 6F is a graph showing a light distribution shape of a fourth comparative example.

FIG. 9A is a graph showing a light distribution shape of a fifth comparative example; FIG. 9B is a graph showing a light distribution shape of a sixth comparative example; and FIG. 9C is a graph showing a light distribution shape of a seventh comparative example.

DETAILED DESCRIPTION OF THE EXEMPLARY EMBODIMENTS

Hereinafter, embodiments of the present invention will be described in detail with reference to the drawings. The present invention is not limited to the contents described below, and can be arbitrarily changed without changing the spirit of the present invention. Further, each drawing used in the description of the embodiments of the present invention schematically shows an illumination device according to the present invention, and in order to improve understanding, partial emphasis, enlargement, reduction, or omission may be performed, and the scale, shape, or the like of each constituent member may not be accurately represented. Further, various numerical values used in the embodiments of the present invention are examples, and can be variously changed as necessary.

Figure 1:
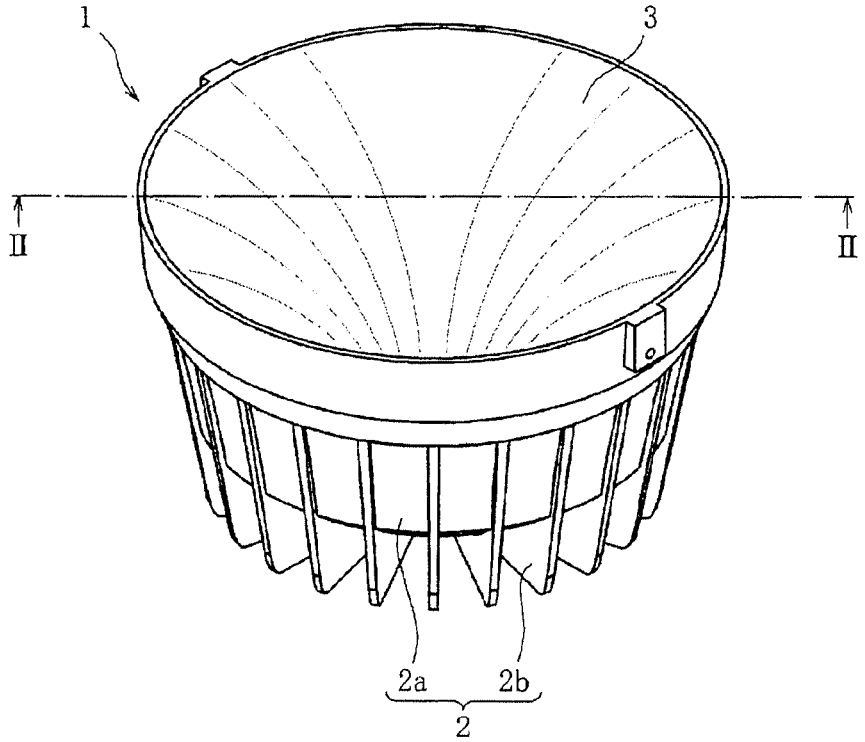
FIG. 1 is a perspective view schematically showing an overall configuration of an illumination device according to the present invention.
Figure 2:
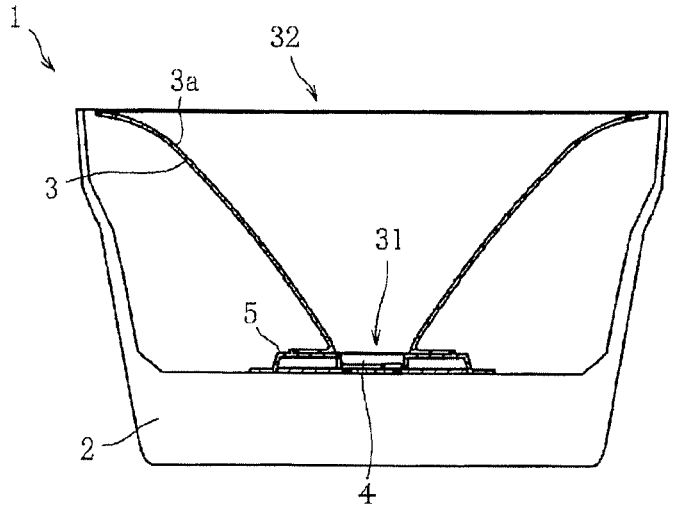
FIG. 2 is a cross-sectional view of the illumination device taken along a line II-II in FIG. 1.

First, a configuration of an illumination device 1 according to an embodiment of the present invention will be described with reference to FIGS. 1 and 2. FIG. 1 is a perspective view schematically showing an overall configuration of the illumination device 1 according to the present invention. FIG. 2 is a cross-sectional view of the illumination device 1 taken along a line II-II in FIG. 1.

The illumination device 1 includes a housing 2, a reflector 3 as a "reflecting part", an LED module 4 as a "semiconductor light emitting device", and a fixing member 5. The illumination device 1 is, for example, a downlight type LED illumination device which is installed so as to fit the housing 2 into a concave portion provided on a ceiling surface, and emits pseudo white light from a vertically downward reflector 3 side.

The housing 2 includes a base 2*a* storing the reflector 3, the LED module 4, or the like inside, and a heat radiator 2*b* provided outside the base 2*a*. The base 2*a* is formed with an opening part for emitting light and protects a storage component such as the reflector 3 and the LED module 4 stored therein. Further, the heat radiator 2*b* releases heat transmitted from the storage component to the outside of the housing 2 via the base 2*a*.

The reflector 3 is disposed inside the base 2*a*, and as shown in FIG. 2, an incident circular opening 31 with a radius R1 on which light from the LED module 4 is incident is formed. Further, the reflector 3 is disposed such that an emission circular opening 32 having an opening with a radius R2 larger than the radius R1 overlaps the opening part of the base 2*a*, and includes a reflecting side surface 3*a* which guides the light from the LED module 4 from the incident circular opening 31 toward the emission circular opening 32. The reflector 3 can be made of metal, resin, or the like. The reflecting side surface 3*a*, which is a surface of the reflector 3, may be a glossy mirror surface, a processed surface such as a surface roughened by embossing, a surface imparted with a facet concave-convex shape, or the like. The shape of the reflecting side surface 3*a* of the reflector 3 will be described in detail below.

In the present embodiment, the LED module 4 is formed in a disk shape, and a light emitting surface is disposed at a central part of an inner bottom surface of the base 2*a* to match the position of the incident circular opening 31 of the reflector 3. The structure of the LED module 4 will be described in detail below.

The fixing member 5 is disposed at the central part of the inner bottom surface of the base 2*a* so as to surround the LED module 4, and integrally supports the housing 2, the reflector 3, and the LED module 4.

Although not shown, a plate or a lens having translucency or light scattering property may be inserted between the fixing member 5 and the reflector 3 to protect the light source and reduce glare of the light source, and a sheet or a plate which converts an optical color may be inserted. In addition, a sheet or a plate having the light scattering property may be provided as a lid over the reflector 3.

Figure 3:
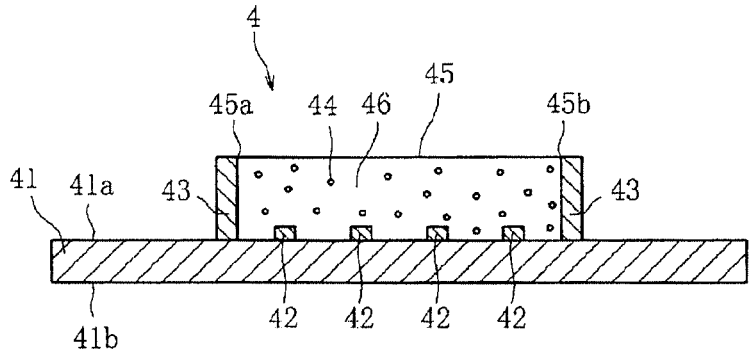
FIG. 3 is a cross-sectional view of an LED module included in the illumination device according to the present invention.

Next, a detailed structure of the LED module 4 will be described with reference to FIG. 3. FIG. 3 is a cross-sectional view of the LED module 4 included in the illumination device according to the present invention. The LED module 4 includes a wiring substrate 41, a plurality of LED chips 42, banks 43, and a sealing material 46 including phosphors 44.

The wiring substrate 41 is, for example, an aluminum substrate having high thermal conductivity. One surface of the wiring substrate 41 is used as a mounting surface 41*a* and is mounted with the plurality of LED chips 42 and an electronic circuit for controlling the operation thereof, and another surface of the wiring substrate 41 is used as a supported surface 41*b* and is supported on an inner bottom surface side of the base 2*a* by the fixing member 5. The wiring substrate 41 controls lighting operation of the LED chips 42 by supplying power to each LED chip 42 via the mounted electronic circuit.

The LED chip 42 is a semiconductor light emitting element which emits light by supplying electric power from the wiring substrate 41. Banks 43 are made of a cured resin having a high viscosity, and are formed as banks surrounding the plurality of LED chips 42 on the wiring substrate 41. Then, the plurality of LED chips 42 are sealed by the banks 43 with the sealing material 46 including the phosphors 44. That is, the LED module 4 is a so-called chip-on-board type light emitting module, and is a light source that is more efficient and more suitable for illumination than a surface mounting type light emitting module. Therefore, it is not necessary to separately dispose a member such as a lens on each LED chip 42, and a decrease in light emission efficiency can be suppressed.

In the present embodiment, an LED chip which emits blue light having a peak wavelength of 450 nm is used as the LED chip 42. Specifically, as such an LED chip, there is a GaN-based LED chip in which, for example, an InGaN semiconductor is used in a light emitting layer. The type and light emitting wavelength characteristic of the LED chip 42 are not limited thereto, and semiconductor light emitting elements such as various LED chips can be used without departing from the scope of the present invention. In the present embodiment, a peak wavelength of the light emitted by the LED chip 42 is preferably in a wavelength range of 360 nm to 480 nm, and more preferably in a wavelength range of 440 nm to 470 nm.

The sealing material 46 including the phosphors 44 filled in a region surrounded by the banks 43 converts wavelengths of the blue light emitted from the LED chip 42. In the LED module 4 according to the present embodiment, the blue light emitted from the LED chip 42 and the light emitted after the blue light is wavelength-converted by the sealing material 46 including the phosphors 44 are combined, and the combined light is emitted from a light emitting surface 45. Here, the phosphor 44 can absorb at least a part of the blue light incident from the LED chip 42 and convert a part of the blue light into yellow light to synthesize white light. Therefore, the phosphor 44 in the present embodiment uses a yellow phosphor which absorbs and excites blue light, and emits light having a wavelength different from that of the blue light when returning to a ground state.

A light emission peak wavelength of the specific yellow phosphor is usually in a wavelength range of 530 nm or more, preferably 540 nm or more, more preferably 550 nm or more, usually 620 nm or less, preferably 600 nm or less, and more preferably 580 nm or less. Among them, for example, $Y_3Al_5O_{12}$:Ce [YAG phosphor], $(Y, Gd)_3Al_5O_{12}$:Ce, $(Sr, Ca, Ba, Mg)_2SiO_4$:Eu, $(Ca, Sr)Si_2N_2O_2$:Eu, α-sialon, $La_3Si_6N_{11}$:Ce (However, a part thereof may be substituted with Ca or O) are preferable as the yellow phosphor.

With the above configuration, the LED module 4 emits light from the light emitting surface 45, which is a surface of the sealing material 46 including the phosphors 44. Here, in the present embodiment, the light emitting surface 45 has a circular shape in a plan view, and a radius thereof is set to the radius R1 similarly to that of the incident circular opening 31. That is, the LED module 4 is a surface light emitting type light source having a circle as the light emitting surface, and a diameter of the circle is set as the width from one end portion 45*a* of the light emitting surface 45 to another end portion 45*b* which faces the one end portion 45*a* with an optical axis as a center. In the present embodiment, the light source is a surface emitting type light source when a light emitting surface diameter of the light source is 1/40 or more than a radius R2 described below.

Figure 4:
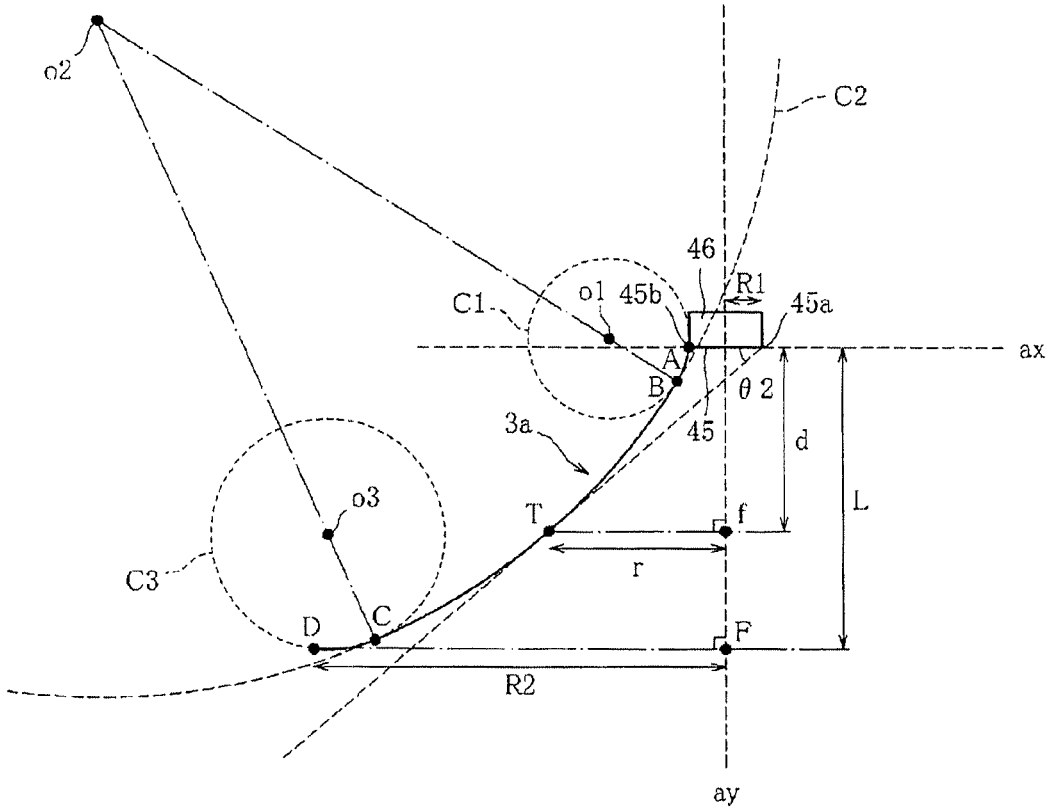
FIG. 4 is a schematic view showing a cross-sectional shape of a reflector according to the present invention.

Next, the shape of the reflecting side surface of the reflector 3 will be described in detail with reference to FIG. 4. FIG. 4 is a schematic view showing a cross-sectional shape of the reflector 3 according to the present invention. More specifically, FIG. 4 schematically shows a cross section of the sealing material 46 including the phosphor 44, and the reflecting side surface 3*a* of the reflector 3 extending in a light emitting direction from the other end portion 45*b* which faces the one end portion 45*a* of the light emitting surface 45. Here, an axis which passes through the one end portion 45*a* and the other end portion 45*b* of the light emitting surface 45 is set as a horizontal axis ax, and an axis which is perpendicular to the horizontal axis ax and passes through a center of the light emitting surface 45 is set as an optical axis ay. That is, when the illumination device 1 is installed on the ceiling surface and used as the downlight, the horizontal axis ax is disposed to be parallel to the ceiling surface, and the optical axis ay is oriented directly below the illumination device 1.

In the present embodiment, the reflecting side surface of the reflector 3 is obtained by rotating a curve which connects an arc AB as "a first arc", an arc BC as "a second arc", and an arc CD as "a third arc" with respect to the optical axis ay. At this time, a trajectory caused by rotation of a point A overlaps a position of the incident circular opening 31 of the radius R1. A trajectory caused by rotation of a point D overlaps a position of the emission circular opening 32 of the radius R2. Here, the portion formed of the arc CD on the reflecting side surface is connected to a point C as necessary. Therefore, when the reflecting side surface 3*a* of the reflector 3 does not include the arc CD, the trajectory caused by rotation of the point C is the position of the emission circular opening 32 of the radius R2. A case where the reflecting side surface 3*a* of the reflector 3 includes the arc CD will be described below. Here, the arc AB is defined by a first circle C1, the arc BC is defined by a second circle C2, and the arc CD is defined by a third circle C3.

The first circle C1 passes through the other end portion 45*b* of the light emitting surface 45, and a center o1 is located on a supported surface 41*b* side than the light emitting surface 45, that is, above the horizontal axis ax in FIG. 4. The first circle C1 is closer to a light emitting surface direction side than the light emitting surface 45, that is, in FIG. 4, the first circle C1 is substantially inscribed in the second circle C2 below the horizontal axis ax in FIG. 4. The arc AB is defined as the point A at a position where the first circle C1 overlaps the end portion 45*b* and the point B at a position where the first circle C1 is substantially inscribed in the second circle C2.

Here, the center o1 of the first circle C1 is in a position shifted toward the supported surface 41*b* side from the light emitting surface 45, and thus the light emitted from the light emitting surface 45 and reflected by the reflecting side surface 3*a* defined by the arc AB is guided in a direction of the emission circular opening 32. Therefore, the light reflected by the reflecting side surface 3*a* defined by the arc AB does not return to the direction of the light emitting surface 45, and a decrease in the light emission efficiency of the illumination device 1 can be suppressed.

Figure 5:
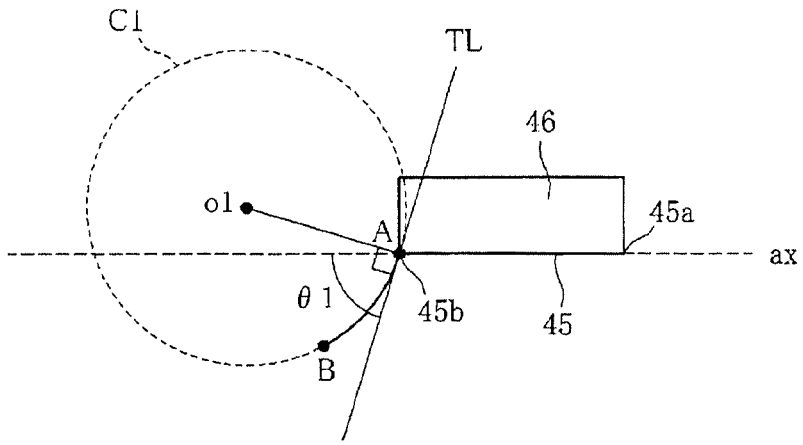
FIG. 5 is an enlarged schematic view in the vicinity of a point A in FIG. 4.
Figure 6A:
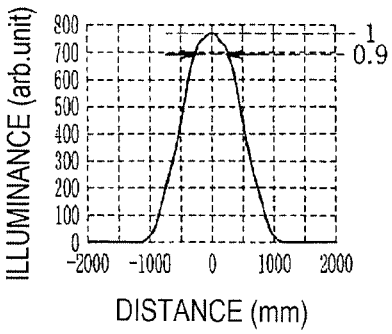
FIGS. 6A to 6F are graphs showing light distribution shapes with respect to irradiation surfaces of examples and comparative examples.
Figure 6B:
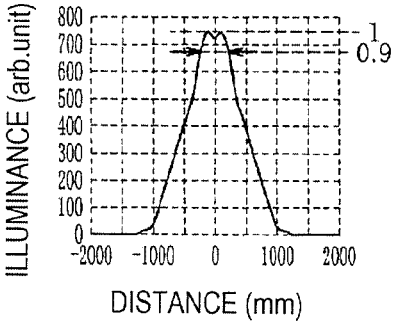
Figure 6C:
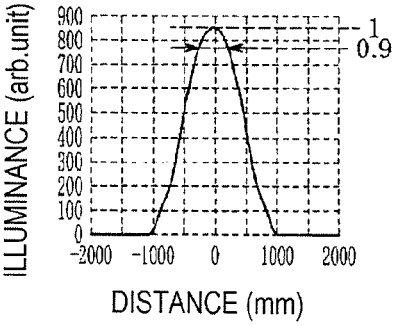
Figure 6D:
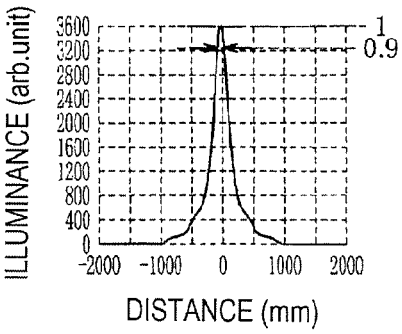
Figure 6E:
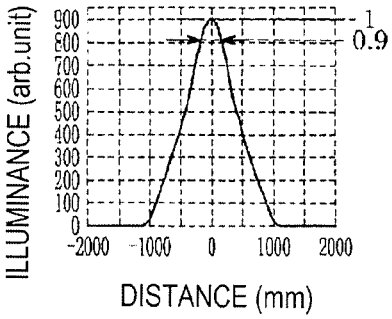
Figure 6F:
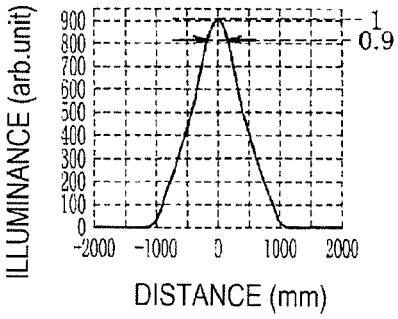

FIG. 5 is an enlarged schematic view in the vicinity of the point A in FIG. 4. In FIG. 5, an angle θ1 between a tangent TL at the point A of the first circle C1 and the light emitting surface 45 is preferably 80 degrees or more. Thus, since the reflector 3 does not guide the light reflected by the reflecting side surface 3*a* defined by the arc AB close to the LED module 4 along a direction in the vicinity of the optical axis ay, a risk of concentrating the reflected light in the vicinity of the optical axis ay can be reduced. In other words, a bright place (light spot) can be prevented from being formed around the optical axis ay with respect to an irradiation surface of the illumination device 1. As a result, when the light distribution on the irradiation surface of the illumination device 1 is calculated, the light distribution shape is a shape in which a center portion is wide and a range of high illuminance is uniformly distributed, and the light distribution shape can be expanded.

When a light spot is formed, the range of high illuminance is concentrated in the center portion, and the light distribution shape is narrowed.

The second circle C2 includes a center o2 on a half line passing through the center o1 of the first circle C1 from the point B, and defines the arc BC connected to the arc AB at the point B. The third circle C3 is substantially inscribed in the second circle C2 at the point C and defines the arc CD. A center of the third circle C3 is defined as a center o3.

Here, the term "substantially inscribed" means that the tangent lines of two circles intersect each other at an angle of, for example, 5 degrees or less at a point where the two circles are connected, and preferably the tangent lines are common, and thus the two circles are inscribed and the two arcs are smoothly connected. Accordingly, occurrence of unevenness of the reflected light can be suppressed at a connection point of the two arcs of the reflecting side surface 3*a* of the reflector 3.

Further, it is preferable that the arc BC has a length of twice or more and 10 times or less of the arc AB. Accordingly, by setting the ratio to be twice or more, the light reflected by the reflecting side surface 3*a* defined by the arc AB close to the LED module 4 can be uniformly dispersed and guided in a beam angle range, and appropriate reflected light can also be guided in the vicinity of the optical axis ay. In other words, a dark place (dark spot) can be prevented from being formed around the optical axis ay with respect to the irradiation surface of the illumination device 1. On the other hand, by setting the ratio is set to 10 times or less, sufficient light can be reflected by the reflecting side surface 3*a* defined by the arc AB close to the LED module 4, and since the light is not deviated and guided in the direction along the optical axis ay, the risk of concentrating the reflected light in the vicinity of the optical axis ay can be reduced. In other words, the bright place (light spot) can be prevented from being formed around the optical axis ay with respect to the irradiation surface of the illumination device 1.

When the dark spot is formed, although the range of high illuminance presents widely in the vicinity of the center, the illuminance decreases at the center portion. Thus, although the light distribution shape is wide, a deep recess exists in the center.

Here, as shown in FIG. 4, a contact point T is a contact point when light emitted at an angle θ2 from the one end portion 45*a* of the light emission surface 45 contacts the reflecting side surface 3*a* of the reflector 3 extending in the light emitting direction from the other opposing end portion 45*b*. At this time, among the light emitted by the LED module 4, an emission angle of direct light emitted from the emission circular opening 32 to the outside of the illumination device 1 without being reflected by the reflector 3 is limited to the angle θ2 or more with respect to the light emission surface 45.

When a distance from the contact point T to a foot f of a perpendicular line perpendicular to the optical axis ay is defined as r, and a distance from the foot f of the perpendicular line to the light emitting surface 45 is defined as d, tan θ2 is expressed by Expression (1) of d/(R1+r). Here, for example, when a value of d/(R1+r) in Expression (1) is 0.6, θ2 is about 30 degrees. That is, by satisfying d/(R1+r)≥0.6, a depression angle of direct light is limited to about 30 degrees or more in the illumination device 1, and since the direct light is not emitted at a shallow angle to the field of view of a person at a position distant from the optical axis ay, glare can be suppressed.

On the other hand, as shown in FIG. 4, the distance from an end point of the emission circular opening 32, that is, from the point D to the foot F of the perpendicular line perpendicular to the optical axis ay, is the radius R2 of the emission circular opening 32. The shape of the reflector 3 is preferably set such that a distance d from the light emitting surface 45 to the foot f of the perpendicular line is half or more of a distance L from the light emitting surface 45 to the foot F of the perpendicular line. Accordingly, the position of the contact T on the arc BC approaches a point C side, and the light emitted by the LED module 4 can be reflected by a wider surface of the reflector 3, and the light distribution shape can be further widened.

Since the reflecting side surface 3*a* of the reflector 3 has the arc CD, the radius R2 of the emission circular opening 32 can be adjusted. Thus, for example, even after the shapes of the arc AB and the arc BC are optimally designed for the characteristics of the LED module 4, the illumination device 1 can change only the size of the emission circular opening 32 without changing the shape thereof, and satisfy constraints such as a recess size of the ceiling where the illumination device 1 is installed.

As described above, the reflector 3 according to the present invention can suppress the occurrence of glare by suppressing the depression angle of the direct light emitted from the LED module 4. Further, since the cross-sectional shape of the reflector 3 from the incident circular opening 31 to the emission circular opening 32 is an arc projecting inwardly, the light emitted by the LED module 4 can be dispersed with respect to the illumination range, and a ½ beam angle can be widened. Moreover, the reflector 3 can reduce the curvature of the arc AB closer to the light emitting surface 45 with respect to the curvature of the arc BC, and can reduce the concentration of the reflected light by the reflector 3 with respect to the optical axis ay. Accordingly, even when the LED is a surface light source, the reflector 3 according to the present invention can improve the light distribution shape while suppressing the occurrence of glare.

EXAMPLES

Next, effects of the present invention will be described by comparing results obtained by evaluating respective characteristics of a reflector shape, the inclination of the reflector represented by formula (1), and a variation of θ1 by simulation.

First Example

The reflector shape of a first example is the same as that of the illumination device 1 according to the present invention described above, and is formed by the reflecting side surface 3*a* of which the cross-sectional shape is defined by connecting the arc AB and the arc BC. The reflector shape of the first example is set on condition that the value of Expression (1), that is, the value of d/(R1+r) is 1.0, and the angle formed by the incident circular opening 31 and the light emitting surface 45, that is, the value of θ1 is 87 degrees.

Second Example

The reflector shape of a second example is the same as that of the first example, and is formed by the reflecting side surface 3*a* of which the cross-sectional shape is defined by connecting the arc AB and the arc BC. The reflector shape of the second example is set on condition that the value of Expression (1) is 1.0 as in the first example, and the value of θ1 is 80 degrees.

Third Example

The reflector shape of a third example is the same as that of the first example and the second example, and is formed by the reflecting side surface 3*a* of which the cross-sectional shape is defined by connecting the arc AB and the arc BC. The reflector shape of the third example is set on condition that the value of Expression (1) is 1.0 as in the first example and the second example, and the value of θ1 is 55 degrees.

First Comparative Example

Unlike the illumination device 1 according to the present invention described above, a reflector of a first comparative example has a cross-sectional shape which is a conventional bowl shape projecting outwardly, and the curvature of the cross section is defined by a parabola. The reflector shape of the first comparative example is set on condition that the value corresponding to Expression (1), which is a limit angle of the direct light, is 0.9, and the value of θ1 is 20 degrees.

Second Comparative Example

Unlike the illumination device 1 according to the present invention described above, a reflector of a second comparative example has a cross-sectional shape which is defined by a hyperbolic shape projecting inwardly. The reflector shape of the second comparative example is set on condition that the value of Expression (1) is 0.9 and the value of θ1 is 90 degrees.

Third Comparative Example

The reflector of a third comparative example includes a reflecting side surface obtained by rotating only the arc BC in the illumination device 1 according to the present invention described above. The reflector shape of the third comparative example is set on condition that the value of Expression (1) is 0.47 and the value of θ1 is 25 degrees.

Fourth Comparative Example

The reflector of a fourth comparative example includes a reflecting side surface obtained by rotating only the arc BC in the same manner as the reflector shape of the third comparative example. The reflector shape of the fourth comparative example is set on condition that the value of Expression (1) is 1.0 and the value of θ1 is 75 degrees.

Evaluation characteristics for the conditions of the first to the third examples and the first to the fourth comparative examples are shown in Table 1. Here, a ½ beam angle, a UGR, and an optical axis condensing index described below are calculated as the evaluation characteristics. Here, the term "UGR" refers to an index for evaluating glare of an illumination fixture, and a lower value means that the glare is less likely to occur.

The UGR is generally preferably 19 or less, and more preferably 18.5 or less. Although the obtained range of the ½ beam angle varies depending on the application, but is preferably 60 degrees or more, more preferably 65 degrees or more, and even more preferably 70 degrees or more. The optical axis condensing index is one index for determining the presence or absence of a light spot, and when the optical axis condensing index is 400 mm or less, it is not preferable because a light spot appears. In an "evaluation" column, an overall evaluation of the illumination device of each example is described. It is preferable that the UGR is 19 or less, the ½ beam angle is 70 degrees or more, and the optical axis condensing index is 450 mm or more, and the overall evaluation is evaluated in four stages: ◎ (particularly good: all the above items are satisfied), ○ (good), Δ (poor), and x (particularly poor).

Further, "-" in the table means an unmeasured item.

In the simulation, the UGR is calculated with a light beam of the light source being 3000 lm.

As a premise of calculating the UGR, calculation was made using Dilax's illumination simulation software with a diameter of 165 mm (height 0 mm) as the light emitting surface diameter of the fixture and SHR=0.25. Further, in the present application, the UGR value is 4H 8H in a parallel view or a vertical view.

the downlight. In FIGS. 6A to 6F, a horizontal axis represents a distance from the illumination device directly below the illumination device (plane center point), and a vertical axis represents illuminance of emitted light at each distance. Further, since the graphs only show the light distribution shapes, the vertical axis is set as an arbitrary unit.

Here, the optical axis condensing index is defined as an index for evaluating the degree of concentration of the emitted light with respect to the vicinity of the optical axis ay. That is, the optical axis condensing index means a width of the irradiation surface in which the illuminance is 0.9 or more when a maximum value of the illuminance in the light distribution shape with respect to the irradiation surface is 1, and corresponds to a width indicated by an arrow in each of FIGS. 6A to 6F. That is, as the value of the optical axis condensing index is larger, the emitted light does not concentrate in the vicinity of the optical axis ay, so that no uneven brightness occurs on the irradiation surface.

From results of Table 1, in the reflector according to the first example, since the ½ beam angle is 70 degrees or more, the UGR is 19 or less, and the value of the optical axis condensing index is 450 mm or more, the overall evaluation is determined as "◎". That is, the reflector according to the first example has a very good light distribution shape, and glare is also suppressed.

The reflector according to the second example is the same as the reflector according to the first example, and since the ½ beam angle is 70 degrees or more, the UGR is 19 or less, and the value of the optical axis condensing index is 450 mm or more, the overall evaluation is determined as "◎".

Regarding the reflector according to the third embodiment, although the value of θ1 is small and the ½ beam angle is not as good as in the first and the second examples, the UGR is 19 or less, and the value of the optical axis condensing index is 450 mm or more, and it can be assumed that no glare occurs, neither a light spot nor a dark spot is formed. Therefore, the overall evaluation is determined as "○".

TABLE 1

Evaluation Characteristics With Respect to Reflector Shapes

| | Cross-Sectional Shape | Value of Expression (1) | θ1 [°] | ½ Beam Angle [°] | UGR | Optical Axis Condensing Index [Mm] | Evaluation |
|---|---|---|---|---|---|---|---|
| First Example | Connecting Arc | 1.0 | 87 | 74 | 18.2 | 500 | ◎ |
| Second Example | Connecting Arc | 1.0 | 80 | 74 | 18.4 | 500 | ◎ |
| Third Example | Connecting Arc | 1.0 | 55 | 65 | 18.0 | 500 | ○ |
| First Comparative Example | Parabola | 0.9 | 20 | 19 | <15 | 100 | X |
| Second Comparative Example | Hyperbola | 0.9 | 90 | 69 | 18.1 | 400 | Δ |
| Third Comparative Example | Single Arc | 0.47 | 25 | 117 | 26 | — | X |
| Fourth Comparative Example | Single Arc | 1.0 | 75 | 69 | 18.1 | 400 | Δ |

FIGS. 6A to 6F are graphs showing light distribution shapes with respect to irradiation surfaces of the examples and the comparative examples. More specifically, FIGS. 6A to 6F respectively show light distribution shapes obtained by simulating the illuminance for an irradiation range when the illumination devices of the first to the third examples and the first, the second and the fourth comparative examples irradiate the irradiation surfaces from a predetermined height as Meanwhile, in the reflector according to the first comparative example, since the ½ beam angle is extremely narrow as 19 degrees and the value of the optical axis condensing index is extremely low as 100 mm, it is assumed that an extreme bright place (light spot) is formed. Therefore, the overall evaluation is determined as "x" Further, also in the reflector according to the second comparative example, since the ½ beam angle is lower than those in the first and second examples, and the value of the optical axis condensing index is also 400 mm, it is assumed that a bright place (light spot) is formed around the optical axis. Therefore, the overall evaluation is determined as "Δ".

In the reflector according to the third comparative example, since the inclination angle of the reflector is close to the horizontal direction, it is confirmed that the numerical value of UGR is particularly high, and glare is particularly likely to occur although the ½ beam angle is wide. Therefore, the overall evaluation is determined as "x".

Further, in the reflector according to the fourth comparative example, since the reflection side surface formed of the arc AB for suppressing the light condensing to the periphery of the optical axis is not provided as in the first and the second examples, and since the ½ beam angle is about the same as that of the second comparative example and the value of the optical axis condensing index is 400 mm, it is assumed that the bright place (light spot) is formed around the optical axis. Therefore, the overall evaluation is determined as "Δ".

Figure 7:
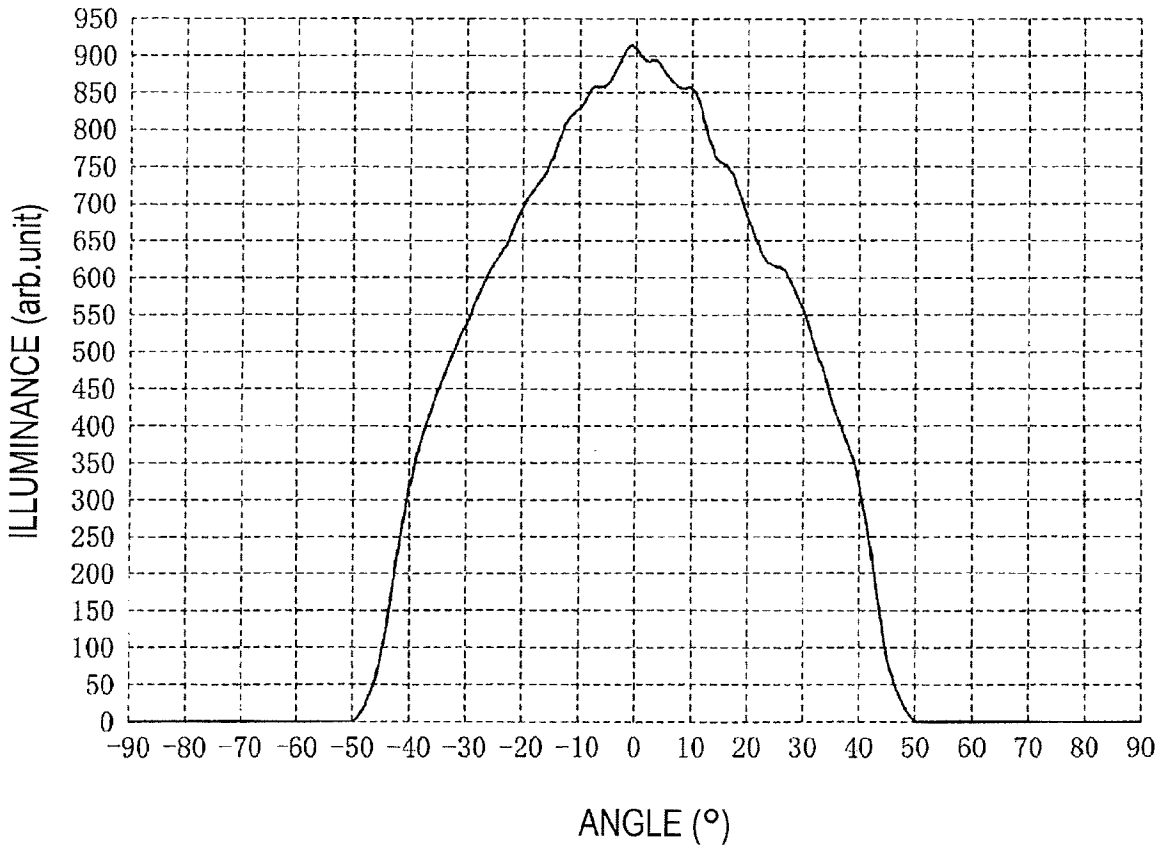
FIG. 7 is a graph showing a light distribution shape by an illumination device of the related art.
Figure 8:
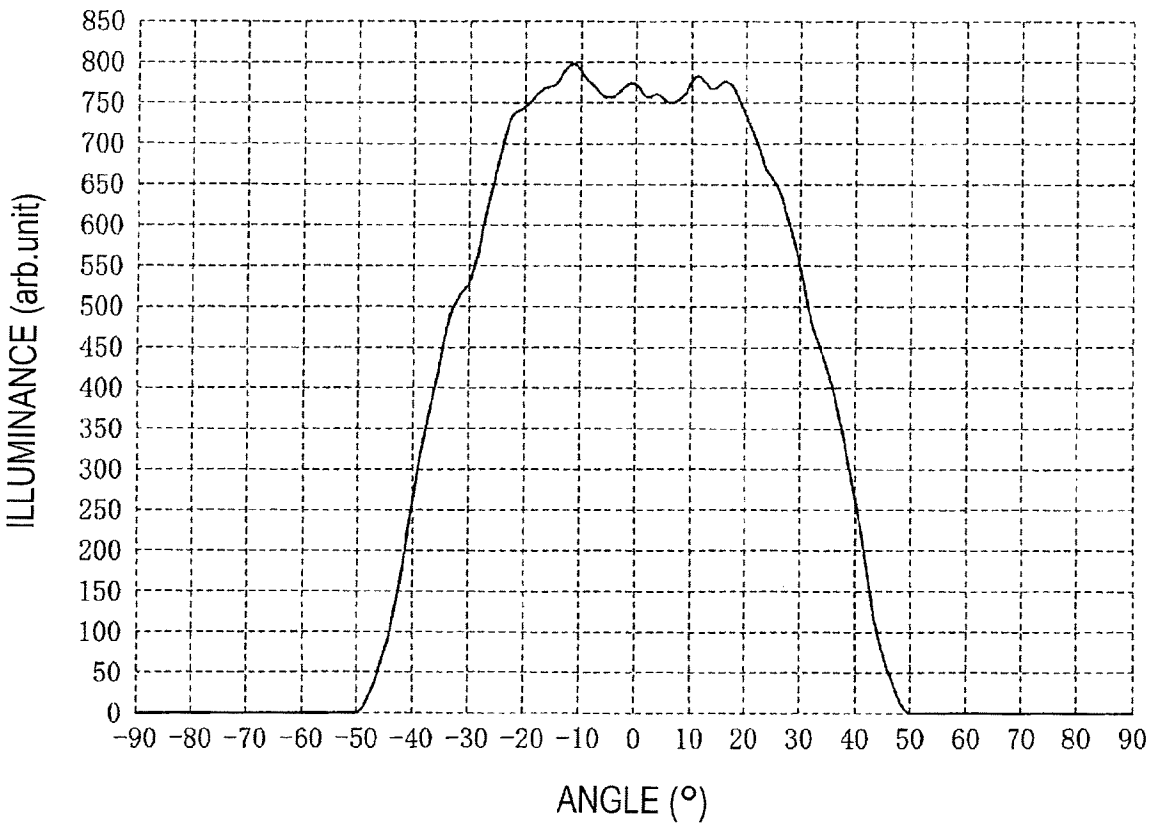
FIG. 8 is a graph showing a light distribution shape by the illumination device according to the present invention.

Next, effects of the present invention on the light distribution shape with respect to the emission angle will be described with reference to FIGS. 7 and 8. FIG. 7 is a graph showing the light distribution shape with respect to the emission angle by the illumination device of the related art, and more specifically, FIG. 7 is a graph of the light distribution shape obtained by simulating the illuminance on the emission angle when the illumination device including a hyperbolic reflector, that is the second comparative example, irradiates the illumination range. FIG. 8 is a graph showing the light distribution shape with respect to the emission angle by the illumination device 1 according to the present invention, and more specifically, FIG. 8 is a graph of the light distribution shape obtained by simulating the illuminance for the emission angle when the illumination device 1 including the reflector 3, that is the first comparative example, irradiates the illumination range. Here, the shape of the reflector of the illumination device of the related art and the shape of the reflector 3 of the illumination device 1 according to the present invention are set such that the value of d/(R1+r) is equal to each other.

FIGS. 7 and 8 show illuminance distribution in a case where a spherical surface with a radius of 1 m centered on the illumination device is a detection surface, and a horizontal axis represents an emission angle of light having an optical axis direction of 0 degrees, and a vertical axis represents illuminance for each emission angle. Further, since the graphs only show the light distribution shapes, the vertical axis is set as an arbitrary unit.

As can be seen in FIG. 7, in the illumination device of the related art, the emission angle of the illumination light including the reflected light is suppressed to about 50 degrees or less. However, since the light distribution shape of the hyperbolic reflector has a pointed shape in the vicinity of 0 degrees, and the emitted light is condensed around the optical axis, unevenness brightness occurs on the irradiation surface.

On the other hand, in FIG. 8 showing the light distribution shape of the illumination device 1 according to the present invention, the emission angle of the illumination light including the reflected light is suppressed to about 50 degrees or less, and no sharp peak is observed in a graph shape in the vicinity of 0 degrees. That is, according to the illumination device 1 of the present invention, since the emitted light is dispersed in the light irradiation region, the output light does not concentrate in the periphery of the optical axis, and a risk of causing uneven brightness on the irradiation surface is reduced. That is, the illumination device 1 according to the present invention can improve the light distribution shape while suppressing the occurrence of glare.

Fifth Comparative Example

Unlike the illumination device 1 according to the present invention described above, a reflector of a fifth comparative example has a cross-sectional shape which is defined by a shape based on a part of an ellipse which projects inwardly. A reference is made to a shape shown in FIG. 3(b) of JP-A-2015-46300. The reflector shape of the fifth comparative example is set on condition that the value of Expression (1) is 1.0 and the value of θ1 is 90 degrees.

Sixth Comparative Example

Unlike the illumination device 1 according to the present invention described above, a reflector of a sixth comparative example has a cross-sectional shape which is projects inwardly and is defined by a shape based on a part of a parabola which is laterally arranged. A reference is made to a shape shown in FIG. 3(a) of JP-A-2015-46300 The reflector shape of the sixth comparative example is set on condition that the value of Expression (1) is 0.8 and the value of θ1 is 90 degrees.

Seventh Comparative Example

Unlike the illumination device 1 according to the present invention described above, a reflector of a seventh comparative example has a cross-sectional shape which is defined by a shape including two regions where the incident circular opening side is a conventional bowl shape based on a parabola which projects outwardly, and a shape which projects inwardly and is based on a part of a circle is connected to the light emitting surface side. A reference is made to a shape shown in FIG. 5 of JP-A-2015-46300. The reflector shape of the seventh comparative example is set on condition that the value of Expression (1) is 1.0 and the value of θ1 is 90 degrees.

Evaluation characteristics for the conditions of the fifth to the seventh comparative examples are shown in Table 2 in the same manner as in the first to the third comparative examples and the first to the fourth comparative examples.

Figure 9A:
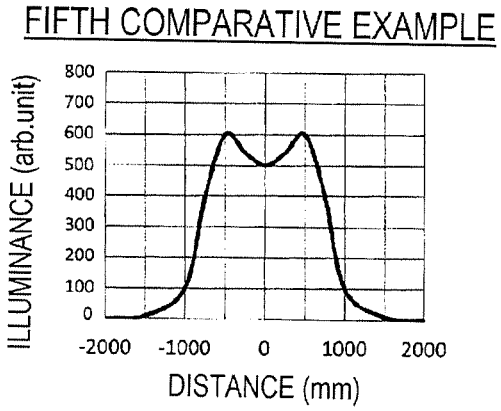
FIGS. 9A to 9C are graphs showing light distribution shapes with respect to irradiation surfaces of comparative examples.
Figure 9B:
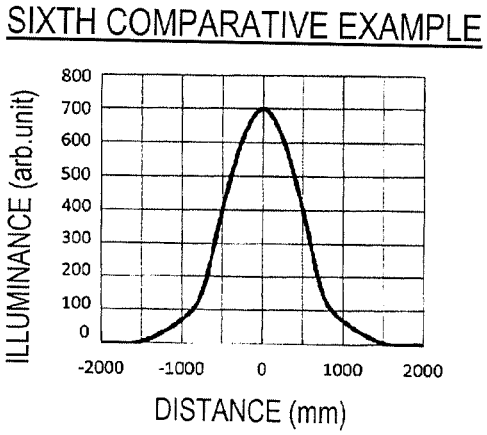
Figure 9C:
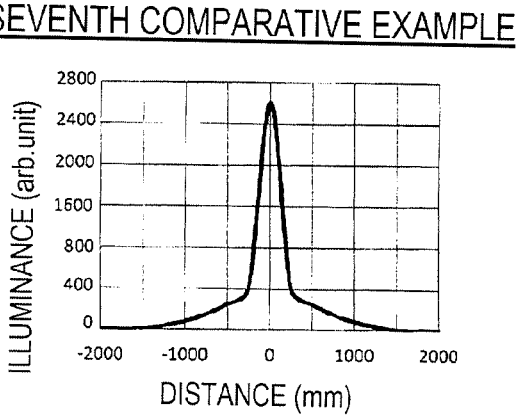

FIGS. 9A to 9C are graphs showing light distribution shapes with respect to the irradiation surfaces of the fifth to the seventh comparative examples. More specifically, FIGS. 9A to 9C respectively show light distribution shapes obtained by simulating the illuminance for an irradiation range when the illumination devices of the fifth to the seventh comparative examples irradiate the irradiation surfaces from a predetermined height as the downlight. In FIGS. 9A to 9C, a horizontal axis represents a distance from the illumination device directly below the illumination device (plane center point), and a vertical axis represents illuminance of emitted light at each distance. Further, since the graphs only show the light distribution shapes, the vertical axis is set as an arbitrary unit.

TABLE 2

Evaluation Characteristics With Respect To Reflector Shapes

| | Cross-Sectional Shape | Value Of Expression (1) | θ1 [°] | ½ Beam Angle [°] | UGR | Optical Axis Condensing Index [Mm] | Evaluation |
|---|---|---|---|---|---|---|---|
| Fifth Comparative Example | Ellipse | 1.0 | 90 | 110 | 25 | — | X |
| Sixth Comparative Example | Lateral Parabola | 0.8 | 90 | 72 | 22 | 500 | Δ |
| Seventh Comparative Example | Combination Of Parabola and Arc | 1.0 | 90 | 22 | — | 100 | X |

From the results shown in Table 2, in the reflector according to the fifth comparative example, it is confirmed that the numerical value of UGR is particularly high, and glare is particularly likely to occur. Further, as shown in the graph of the distribution shape in FIG. 9A, it is found that a central part has a light distribution shape with a dent, and a dark place (dark spot) is formed around the optical axis. Since a substantially vertical wall surface in the vicinity of the light source is large, it is considered that the emitting light is deflected and a depression can be formed in the central part in the vicinity of the optical axis. Therefore, the overall evaluation is determined as "x".

In the reflector according to the sixth comparative example, the values of the ½ beam angle and the optical axis condensing index were good, but it is confirmed that the numerical value of UGR is high and glare is likely to occur. Therefore, the overall evaluation is determined as "Δ".

Further, in the reflector according to the seventh comparative example, since the ½ beam angle is extremely narrow and the value of the optical axis condensing index is extremely low, it is assumed that an extreme bright place (light spot) is formed. Therefore, the overall evaluation is determined as "x".

Although the present invention has been described in detail with reference to specific embodiments, it will be apparent to those skilled in the art that various modifications and variations are possible without departing from the spirit and scope of the present invention.

Reference numerals corresponding to elements described in the embodiment will be listed as below.

1: illumination device
2: housing
2*a*: base
2*b*: heat radiator
3: reflector
3*a*: reflecting side surface
4: LED module
5: fixing member
31: incident circular opening
32: emission circular opening
41: wiring substrate
41*a*: mounting surface
41*b*: supported surface
42: LED chip
43: bank
44: phosphor
45: light emitting surface
45*a*, 45*b*: end portion
46: sealing material

What is claimed is:

1. An illumination device comprising:

a semiconductor light emitting device which includes a light emitting surface and a supported surface located on a side opposite to the light emitting surface; and a reflecting part which includes an incident circular opening with a radius R1 on which light from the semiconductor light emitting device is incident, an emission circular opening which emits light incident from the semiconductor light emitting device and includes an opening with a radius R2 larger than the radius R1, and a reflecting side surface which guides light from the incident circular opening toward the emission circular opening, wherein the reflecting side surface of the reflecting part is a surface obtained by rotating a curve with respect to an optical axis of the semiconductor light emitting device, the curve being obtained by connecting a first arc which is defined by a first circle and extends from the light emitting surface of the semiconductor light emitting device in a light emitting direction and a second arc which is defined by a second circle substantially inscribed to the first circle, wherein a center of the first circle is located in a position shifted toward the supported surface from the light emitting surface, and wherein when a contact point between light emitted from one end of the light emitting surface and the second arc which is connected to the first arc extending in a light emitting direction from another end portion which faces one end portion of the light emitting surface is defined as a contact point T, a distance r from the contact point T to a foot of a perpendicular line perpendicular to the optical axis of the semiconductor light emitting device, a distance d from the foot of the perpendicular line to the light emitting surface, and the radius R1 satisfy $d/(R1+r) \geq 0.6$.

2. The illumination device according to claim 1, wherein an angle between a tangent line at the incident circular opening of the first circle and the light emitting surface of the semiconductor light emitting device is 80 degrees or more.

3. The illumination device according to claim 1, wherein a tangent line of the first circle and a tangent line of the second circle intersect each other at an angle of 5 degrees or less at a connecting point of the first arc and the second arc.

4. The illumination device according to claim 1, wherein a length of the second arc is twice or more and 10 times or less of that of the first arc.

5. The illumination device according to claim 1, wherein the distance d is half or more of a distance L between a foot of a perpendicular line perpendicular to the optical axis from an end point of the emission circular opening and the light emitting surface.

6. The illumination device according to claim 1, wherein the reflecting side surface of the reflecting part is a surface obtained by rotating a curve with respect to the optical axis, the curve being obtained by further connecting a third arc which is defined by a third circle substantially inscribed to the second circle and the second arc.

7. The illumination device according to claim 1, wherein the semiconductor light emitting device is a chip-on board-type device including an LED.

* * * * *